US011635175B1

(12) United States Patent
Wang

(10) Patent No.: US 11,635,175 B1
(45) Date of Patent: Apr. 25, 2023

(54) LED LAMP WITH SOFT RUBBER STEM

(71) Applicant: DONGGUAN HUIHUAN LIGHTING CO., LTD., Dongguan (CN)

(72) Inventor: Song Wang, Chengdu (CN)

(73) Assignee: DONGGUAN HUIHUAN LIGHTING CO., LTD., Dongguan (CN)

( * ) Notice: Subject to any disclaimer, the term of this patent is extended or adjusted under 35 U.S.C. 154(b) by 0 days.

(21) Appl. No.: 17/683,383

(22) Filed: Mar. 1, 2022

(51) Int. Cl.
*F21K 9/238* (2016.01)
*F21K 9/232* (2016.01)
*F21Y 115/10* (2016.01)

(52) U.S. Cl.
CPC ..... *F21K 9/238* (2016.08); *F21K 9/232* (2016.08); *F21Y 2115/10* (2016.08)

(58) Field of Classification Search
CPC . F21K 9/235; F21K 9/90; F21K 9/237; F21K 9/278; F21K 9/232; F21K 9/23; F21V 23/001; F21V 19/003; F21V 17/06; F21V 29/508; F21V 25/10; F21V 23/02; F21V 23/003; F21V 23/06; F21V 17/101; H05B 47/24; F21Y 2115/10; F21Y 2103/10
See application file for complete search history.

(56) References Cited

U.S. PATENT DOCUMENTS 10,415,764 B1 * 9/2019 Lei ..... F21K 9/232
10,914,428 B2 * 2/2021 Wang ..... F21V 23/005
2019/0195435 A1 * 6/2019 Ye ..... F21K 9/232

FOREIGN PATENT DOCUMENTS

CN 110425434 A * 11/2019
CN 210921312 U * 7/2020

OTHER PUBLICATIONS

Search English translation of CN 110425434 A (Year: 2019).*

* cited by examiner

*Primary Examiner* — Omar Rojas Cadima

(57) ABSTRACT

The present invention relates to the technical field of LEDs, and discloses an LED lamp with a soft rubber stem, comprising a lamp holder, a lamp housing and a lamp socket, a metal wire, an LED lamp bar, a resistor as well as a first lead and a second lead, wherein the lamp stem and the lamp holder are electrically connected in the lamp housing; the soft lamp socket, in which an accommodating hole for accommodating the resistor is disposed, is made of high-temperature-resistant rubber; one end of the LED lamp bar is electrically connected to the upper end of the metal wire, and the other end is electrically connected to the second lead. The lamp adopts the soft lamp socket and has better sealing performance, so that stream and the like are prevented from entering the lamp housing to affect the performance of the lamp.

8 Claims, 4 Drawing Sheets

LED LAMP WITH SOFT RUBBER STEM

TECHNICAL FIELD

The present invention relates to the technical field of LED lamps, and in particular, to an LED lamp with a soft rubber stem.

BACKGROUND ART

At present, LED lamps have been widely used in industrial, domestic, mining and other environments. The general structure of an existing LED includes a lamp holder, a lampshade and a lamp wick component. During connection and assembly, a lamp wick is connected to the lampshade, and the lamp wick component is generally assembled with the lampshade through a ceramic base; then, the lampshade is sealed with the ceramic base; and finally, the lamp holder sleeves the lamp. However, this assembly way is complex in process; and in addition, during assembly, defective products are easily generated between the ceramic base and the lampshade. Therefore, the inventor makes improvement.

Technical Solution of the Invention

To overcome the defects in the prior art, the present invention provides an LED lamp with a soft rubber stem. The LED lamp has the advantages of easy assembly and low cost.

To achieve the objective, the present invention provides an LED lamp with a soft rubber stem, including a lamp holder, a lamp housing and a lamp socket. The lamp stem and the lamp holder are electrically connected and are disposed in the lamp housing. The lamp socket is a soft lamp socket made of high-temperature-resistant rubber. The LED lamp further includes a metal wire, an LED lamp bar, a resistor as well as a first lead and a second lead connecting the two ends of the resistor. The metal wire passes through the soft lamp socket, an accommodating hole for accommodating the resistor is disposed in the soft lamp socket, the resistor is disposed in the accommodating hole, and the upper end surface of the resistor is positioned in an opening of the accommodating hole. One end of the LED lamp bar is electrically connected to the upper end of the metal wire, and the other end of the LED lamp bar is electrically connected to the second lead.

Further, metal end covers are disposed at the two ends of the resistor, and both the first lead and the second lead are welded with the metal end covers.

Further, an accommodating hole for accommodating the resistor is disposed in the soft lamp socket, and a central axis of the accommodating hole is parallel to the metal wire.

Further, one end of the soft lamp socket has a diameter of D1, and the other end of the soft lamp socket has a diameter of D2, D1 being greater than D2.

Further, the metal wire has a diameter of 0.2-0.5 mm, and the first lead and the second lead have diameters of 0.1-0.3 mm.

Further, a bending part which is electrically connected to the LED lamp bar is disposed at the upper end of the metal wire.

Further, the resistor element has a resistance value of 0.1-100 K ohms.

Further, the metal wire, the resistor, the first lead and the second lead connecting the two ends of the resistor, and the soft lamp socket are formed by injection molding.

Beneficial effects: compared with the prior art, the present invention provides an LED lamp with a soft rubber stem, which mainly has the following technical advantages.

Firstly, with the soft lamp socket, the lamp is connected to the lamp housing to achieve better sealing performance, so that steam and the like are prevented from entering the lamp housing to affect the performance of the lamp.

Secondly, the soft lamp socket is more convenient to assemble, does not need to seal again while assembled with the lamp housing, and can be sealed with the lamp housing.

Thirdly, the metal wire, the resistor, the first lead and the second lead connecting the two ends of the resistor, and the soft lamp socket are integrally formed by injection molding, so that assembly processes are greatly reduced.

Fourthly, the lamp has better heat dissipation, so that the outdoor snow melting effect of the lamp is improved.

REFERENCE NUMERALS

1, soft lamp socket; 11, accommodating hole; 2, metal wire; 21, bending part; 3, LED lamp bar; 41, resistor; 42, first lead; 43, second lead; 44, metal end cover; 5, lamp holder; and 6, lamp housing.

DETAILED DESCRIPTION

Figure 1:
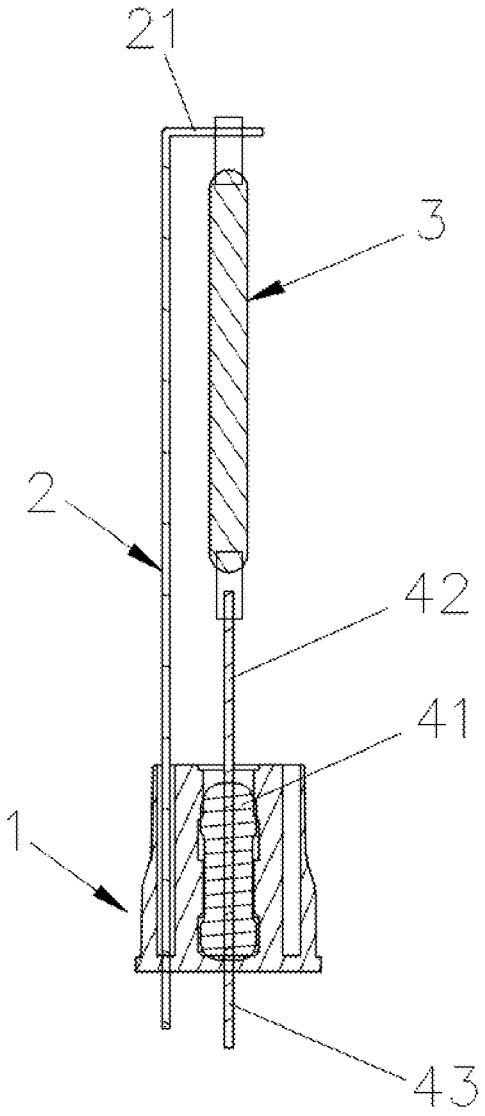
FIG. 1 is a structural diagram of the present invention.
Figure 2:
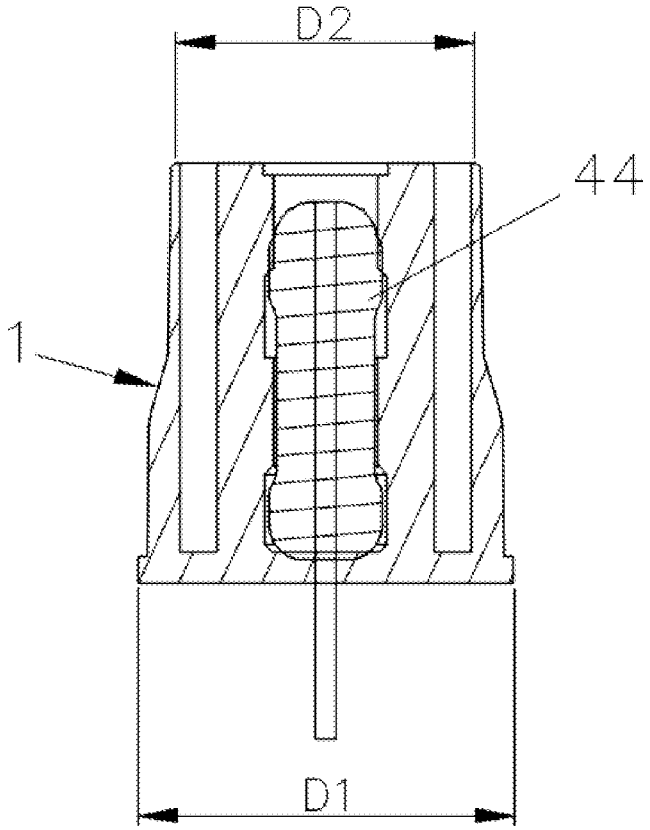
FIG. 2 is a structural diagram of a soft lamp socket of the present invention.
Figure 3:
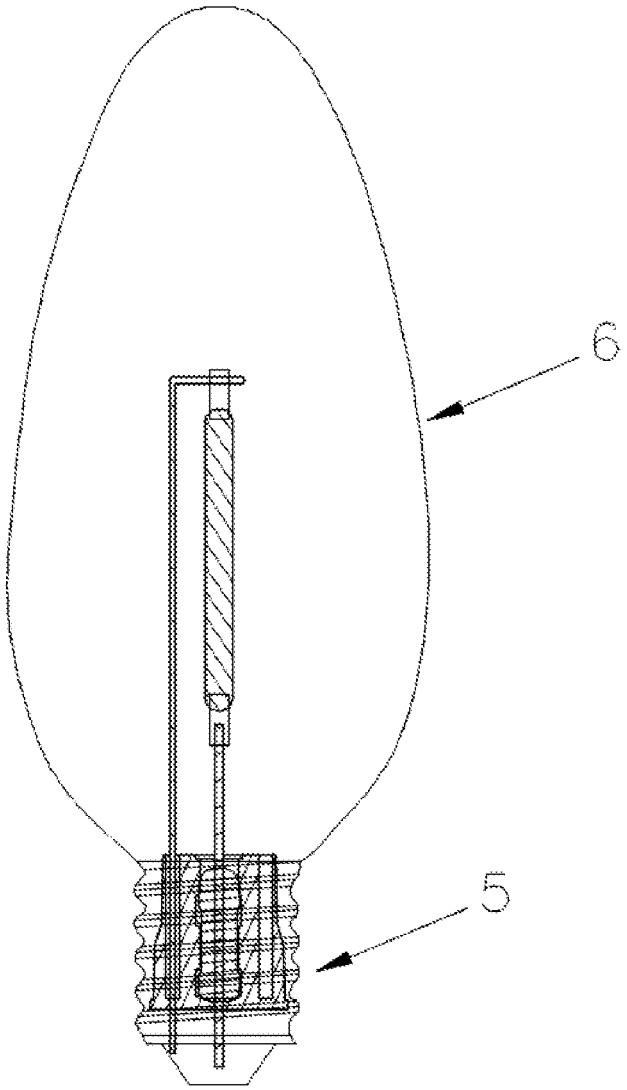
FIG. 3 is a structural diagram of a lamp of the present invention.
Figure 4:
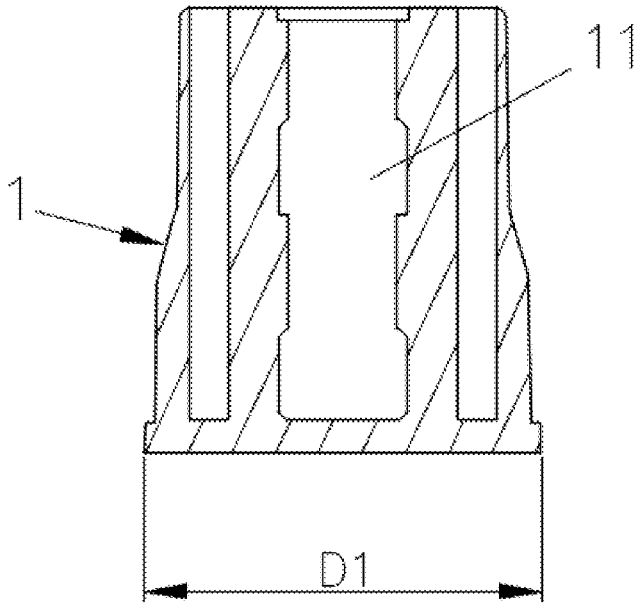
FIG. 4 is a structural diagram of an accommodating hole of a soft lamp socket.

The present invention will be described in detail in conjunction with FIG. 1 to FIG. 4.

The present invention mainly belongs to the field of LED lamps, and specifically provides an LED lamp with a soft rubber stem, including a lamp holder 5, a lamp housing 6 and a lamp socket. The lamp stem and the lamp holder are electrically connected and are disposed in the lamp housing. The lamp socket is a soft lamp socket 1 made of high-temperature-resistant rubber, namely PTE capable of resisting to a high temperature of 150° C., which also can be equivalently replaced with other materials in case of guaranteeing that a contact surface of the lamp socket has softness for sealing. The LED lamp further includes a metal wire 2, an LED lamp bar 3, a resistor 41 as well as a first lead 42 and a second lead 43 connecting the two ends of the resistor 41. The metal wire 2 passes through the soft lamp socket 1, and the resistor 41 is disposed on the soft lamp socket 1. The resistor 41 element has a resistance value of 0.1-100 K ohms; and one end of the LED lamp bar 3 is electrically connected to the upper end of the metal wire 2 and the other end of the LED lamp bar 3 is electrically connected to the second lead 43. During assembly, the soft lamp socket 1 can be directly in sealing connection to the lamp housing made of a glass or plastic material, so that the sealing process in an existing assembly process is reduced, and the manufacturing cost is reduced.

In the technical solution, metal end covers 44 are disposed at the two ends of the resistor 41, and both the first lead 42 and the second lead 43 are welded with the metal end covers 44. The metal end covers 44 are disposed at the two ends of the resistor 41, so that the first lead 42 and the second lead 43 are connected more conveniently, and can be directly formed quickly by processes such as butt-welding. In addition, the welding efficiency is high and the welding quality is high.

To assemble the resistor 41 more conveniently, an accommodating hole for accommodating the resistor 41 is disposed in the soft lamp socket 1, and a central axis of the accommodating hole is parallel to the metal wire 2. The accommodating hole 11 for accommodating the resistor is disposed in the soft lamp socket, the resistor is disposed in the accommodating hole 11, and the upper end surface of the resistor is positioned in an opening of the accommodating hole. When the resistor 41 is disposed in the accommodating hole, the resistor is integrally and completely positioned inside the accommodating hole as the depth of the accommodating hole is greater than that of the resistor 41, so that light emitted by the LED lamp bar is prevented from being shielded, and better light effect is achieved.

In the embodiment, one end of the soft lamp socket 1 has a diameter of D1, and the other end of the soft lamp socket has a diameter of D2, D1 being greater than D2. The end with the smaller diameter D2 is generally disposed inside the lamp housing 6, so that an occupied space inside the lamp housing 6 is reduced and the light effect is improved; and the end with the greater diameter D1 is directly matched with the lamp housing 6 for sealing.

In the technical solution, the diameter of the metal wire 2 is preferably greater than the diameter of the first lead 42 or the second lead 43. The metal wire 2 is utilized for supporting the whole lamp stem, so that certain supporting strength is achieved. The metal wire 2 has a diameter of 0.2-0.5 mm, and the first lead 42 and the second lead 43 have diameters of 0.1-0.3 mm.

To facilitate connection, a bending part 21 which is electrically connected to the LED lamp bar 3 is disposed at the upper end of the metal wire 2.

As a preferable embodiment, the metal wire 2, the resistor 41, the first lead 42 and the second lead 43 connecting the two ends of the resistor 41, and the soft lamp socket 1 are formed by injection molding. In injection molding, the metal wire 2 and the resistor 41 as well as the first lead 42 and the second lead 43 are disposed in a forming mold of the soft lamp socket 1. When the soft lamp socket 1 is formed, an insert is directly adopted for forming in the mold, so that the assembly process of the metal wire 2 and the resistor 41 can be further reduced, and the labor power and the manufacturing cost are reduced to the greatest extent.

The above content is only a preferred embodiment of the present invention, and those skilled in the art will have a change in the specific embodiment and the range of application according to the idea of the present invention. The content of the present specification should not be construed as a limit to the present invention.

The invention claimed is:

1. An LED lamp, the LED lamp comprising a lamp holder, a lamp housing, a lamp socket, a metal wire, an LED lamp bar, a resistor, and a first lead and a second lead respectively connected to both ends of the resistor; wherein the lamp socket and the lamp holder are connected to each other, and wherein the lamp socket is disposed in the lamp housing; wherein the lamp socket is an elastic lamp socket made of a high-temperature-resistant rubber; wherein the metal wire passes through the elastic lamp socket, wherein an accommodating hole used for accommodating the resistor is defined in the elastic lamp socket, and an upper end surface of the resistor is positioned at an inner side of an opening of the accommodating hole; and wherein one end of the LED lamp bar is electrically connected to an upper end of the metal wire, and other end of the LED lamp bar is electrically connected to the second lead;

wherein the elastic lamp socket is fitted with the lamp housing to automatically achieve a sealed connection therebetween by virtue of the elasticity of the elastic lamp socket itself wherein the upper end of the resistor is exposed out of the accommodating hole;

wherein a diameter of the metal wire is preferably greater than the diameter of the first lead or the second lead, and the metal wire is configured for supporting a whole lamp stem, so that certain supporting strength is achieved.

2. The LED lamp according to claim 1, wherein metal end covers are disposed at the two ends of the resistor, and both the first lead and the second lead are welded with the metal end covers.

3. The LED lamp according to claim 1, wherein the central axis of the accommodating hole is parallel to the metal wire, and the depth of the accommodating hole is greater than the length of the resistor so that the resistor is fully embedded inside the accommodating hole.

4. The LED lamp according to claim 1, wherein one end of the elastic lamp socket has a diameter of D1, and other end of the elastic lamp socket has a diameter of D2, D1 being greater than D2.

5. The LED lamp according to claim 1, wherein the metal wire has a diameter of 0.2-0.5 mm, and the first lead and the second lead have diameters of 0.1-0.3 mm.

6. The LED lamp according to claim 1, wherein a bending part which is electrically connected to the LED lamp bar is disposed at the upper end of the metal wire.

7. The LED lamp according to claim 1, wherein the resistor has a resistance value of 0.1-100 k ohms.

8. The LED lamp according to claim 1, wherein the metal wire, the resistor as well as the first lead and the second lead connecting the two ends of the resistor, and the elastic lamp socket are formed by injection molding.

* * * * *